US008029328B2

(12) United States Patent
Wei et al.

(10) Patent No.: US 8,029,328 B2
(45) **Date of Patent: *Oct. 4, 2011**

(54) METHOD FOR MANUFACTURING FIELD EMISSION ELECTRON SOURCE HAVING CARBON NANOTUBES

(75) Inventors: Yang Wei, Bei-Jing (CN); Liang Liu, Bei-Jing (CN); Shou-Shan Fan, Bei-Jing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 447 days.

This patent is subject to a terminal disclaimer.

(21) Appl. No.: 12/006,335

(22) Filed: Dec. 29, 2007

(65) Prior Publication Data

US 2009/0117808 A1 May 7, 2009

(30) Foreign Application Priority Data

Nov. 2, 2007 (CN) ..... 2007 1 0124244

(51) Int. Cl.
*H01J 9/00* (2006.01)
*H01J 9/04* (2006.01)

(52) U.S. Cl. ..... 445/50; 445/49; 445/51

(58) Field of Classification Search ..... 445/49, 445/50, 51

See application file for complete search history.

(56) References Cited

U.S. PATENT DOCUMENTS

| | | | | |
|---|---|---|---|---|
| 7,586,249 | B2 | 9/2009 | Jiang et al. | |
| 7,704,480 | B2 * | 4/2010 | Jiang et al. | 423/447.2 |
| 2003/0186625 | A1 * | 10/2003 | Nakayama et al. | 451/28 |
| 2004/0095050 | A1 | 5/2004 | Liu et al. | |
| 2007/0145878 | A1 | 6/2007 | Liu et al. | |
| 2007/0166223 | A1 | 7/2007 | Jiang et al. | |
| 2008/0170982 | A1 | 7/2008 | Zhang et al. | |
| 2009/0239439 | A1 * | 9/2009 | Wei et al. | 445/46 |

FOREIGN PATENT DOCUMENTS

| | | | |
|---|---|---|---|
| CN | 1501422 | A | 6/2004 |
| CN | 1941249 | A | 4/2007 |
| CN | 1982209 | A | 6/2007 |
| CN | 1988108 | A | 6/2007 |
| CN | 101007366 | A | 8/2007 |
| JP | 2003502798 | | 1/2003 |
| JP | 2004303521 | | 10/2004 |
| WO | WO0077813 | | 12/2000 |
| WO | WO2007015710 | | 2/2007 |
| WO | WO 2007015710 | A2 * | 2/2007 |

* cited by examiner

*Primary Examiner* — Nimeshkumar Patel
*Assistant Examiner* — Anthony Perry
(74) *Attorney, Agent, or Firm* — Altis Law Group, Inc.

(57) ABSTRACT

A method for manufacturing a field emission includes: providing a CNT array; drawing a bundle of CNTs from the CNT array to form a CNT yarn; soaking the CNT yarn into an organic solvent, and shrinking the CNT yarn into a CNT string after the organic solvent volatilizing; applying a voltage between two opposite ends of the CNT string; bombarding a predetermined point of the CNT string by an electron emitter, until the CNT string snapping; and attaching the snapped CNT string to a conductive base, and achieving a field emission electron source. The field emission efficiency of the field emission electron source is high.

20 Claims, 8 Drawing Sheets

METHOD FOR MANUFACTURING FIELD EMISSION ELECTRON SOURCE HAVING CARBON NANOTUBES

RELATED APPLICATIONS

This application is related to commonly-assigned, co-pending application: U.S. patent application Ser. No. 12/006,305, entitled "METHOD FOR MANUFACTURING FIELD EMISSION ELECTRON SOURCE HAVING CARBON NANOTUBE", filed on Dec. 29, 2007 and U.S. patent application Ser. No. 12/006,334, entitled "FIELD EMISSION ELECTRON SOURCE HAVING CARBON NANOTUBES AND METHOD FOR MANUFACTURING THE SAME", filed on Dec. 29, 2007. The disclosure of the respective above-identified application is incorporated herein by reference.

BACKGROUND

1. Field of the Invention

The invention relates to methods for manufacturing field emission electron source and, particularly, to a method for manufacturing field emission electron source having carbon nanotubes.

2. Discussion of Related Art

Carbon nanotubes (CNTs) produced by means of arc discharge between graphite rods were first discovered and reported in an article by Sumio Iijima, entitled "Helical Microtubules of Graphitic Carbon" (Nature, Vol. 354, Nov. 7, 1991, pp. 56-58). CNTs also feature extremely high electrical conductivity, very small diameters (much less than 100 nanometers), large aspect ratios (i.e. length/diameter ratios) (greater than 1000), and a tip-surface area near the theoretical limit (the smaller the tip-surface area, the more concentrated the electric field, and the greater the field enhancement factor). These features tend to make CNTs ideal candidates for field emission electron sources.

Generally, a field emission electron source having CNTs includes a conductive base and CNTs formed on the conductive base. The CNTs acts as emitter of the field emission electron source. The methods adopted for forming the CNTs on the conductive base mainly include mechanical methods and in-situ synthesis methods. The mechanical method is performed by respectively placing single CNT on a conductive base by an Atomic force microscope (AFM), then fixing CNT on the conductive base by conductive pastes or adhesives. However, the controllability of the mechanical method is less than desired, because single CNT is so tiny in size.

The in-situ synthesis method is performed by coating metal catalysts on a conductive base and synthesizing CNTs on the conductive base directly by means of chemical vapor deposition (CVD). However, the mechanical connection between the CNTs and the conductive base often is relatively weak and thus unreliable. In factual use, such CNTs are easy to be drawn away from the conductive base due to the electric field force, which would damage the field emission electron source and/or decrease its performance. Furthermore, the shield effect between the adjacent CNTs may reduce the field emission efficiency thereof.

What is needed, therefore, is a controllable method for manufacturing a field emission source employing CNTs, which has a firm mechanical connection between CNTs and the conductive base, and has a high field emission efficiency.

SUMMARY

A method for manufacturing a field emission includes: providing a CNT array; drawing a bundle of CNTs from the CNT array to form a CNT yarn; soaking the CNT yarn into an organic solvent, and shrinking the CNT yarn into a CNT string after the organic solvent volatilizing; applying a voltage between two opposite ends of the CNT string; bombarding a predetermined point of the CNT string by an electron emitter, until the CNT string snapping; and attaching the snapped CNT string to a conductive base, and achieving a field emission electron source.

Compared with the conventional method, the present method has the following advantages: firstly, a CNT string, which is in a larger scale than the CNT, is used as the electron emitter, and thus the present method is more controllable. Secondly, the CNT string is attached to the conductive base by a conductive paste, and thus the connection is firm. Thirdly, the broken end portion of the CNT string is in a tooth-shape structure, which can prevent from the shield effect caused by the adjacent CNTs. Further, the CNT string is snapping by applying a voltage and an electron emitter thereon, the electric and thermal conductivity, and mechanical strength of the CNT string can be improved. Therefore, the field emission efficiency of the field emission electron source is improved. Fourthly, by an electron emitter bombarding, the location of the CNT string snapping can be precisely controlled, and thus the field emission electron source can be easily manufactured.

Other advantages and novel features of the present method will become more apparent from the following detailed description of preferred embodiments when taken in conjunction with the accompanying drawings.

BRIEF DESCRIPTION OF THE DRAWINGS

Many aspects of the present method can be better understood with reference to the following drawings. The components in the drawings are not necessarily to scale, the emphasis instead being placed upon clearly illustrating the principles of the present method.

Figure 1:
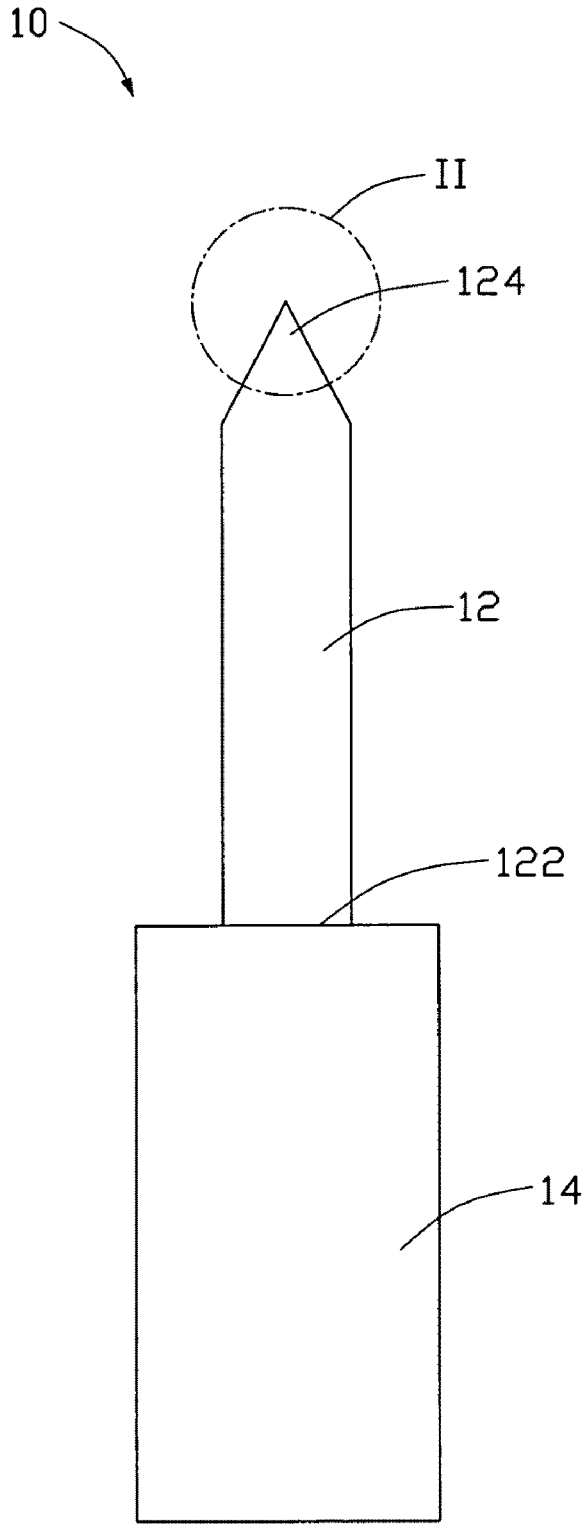
FIG. 1 is a schematic, cross-sectional view, showing a field emission electron source.

Corresponding reference characters indicate corresponding parts throughout the several views. The exemplifications set out herein illustrate at least one preferred embodiment of the present method, in one form, and such exemplifications are not to be construed as limiting the scope of the invention in any manner.

DETAILED DESCRIPTION OF PREFERRED EMBODIMENTS

Reference will now be made to the drawings to describe the preferred embodiments of the present method, in detail.

Referring to FIG. 1, a field emission electron source 10 includes a CNT string 12 and a conductive base 14. The CNT string 12 includes an end portion 122 and a broken end portion 124. The CNT string 12 is attached to the conductive base 14 with the end portion 122 being in contact with and electrically connecting to the surface of the conductive base 14. A included angle between the longitudinal axis of CNT string 12 with the surface of the conductive base 14 can be equal to and more than 0 degree and equal to and less than 90 degrees.

Figure 2:
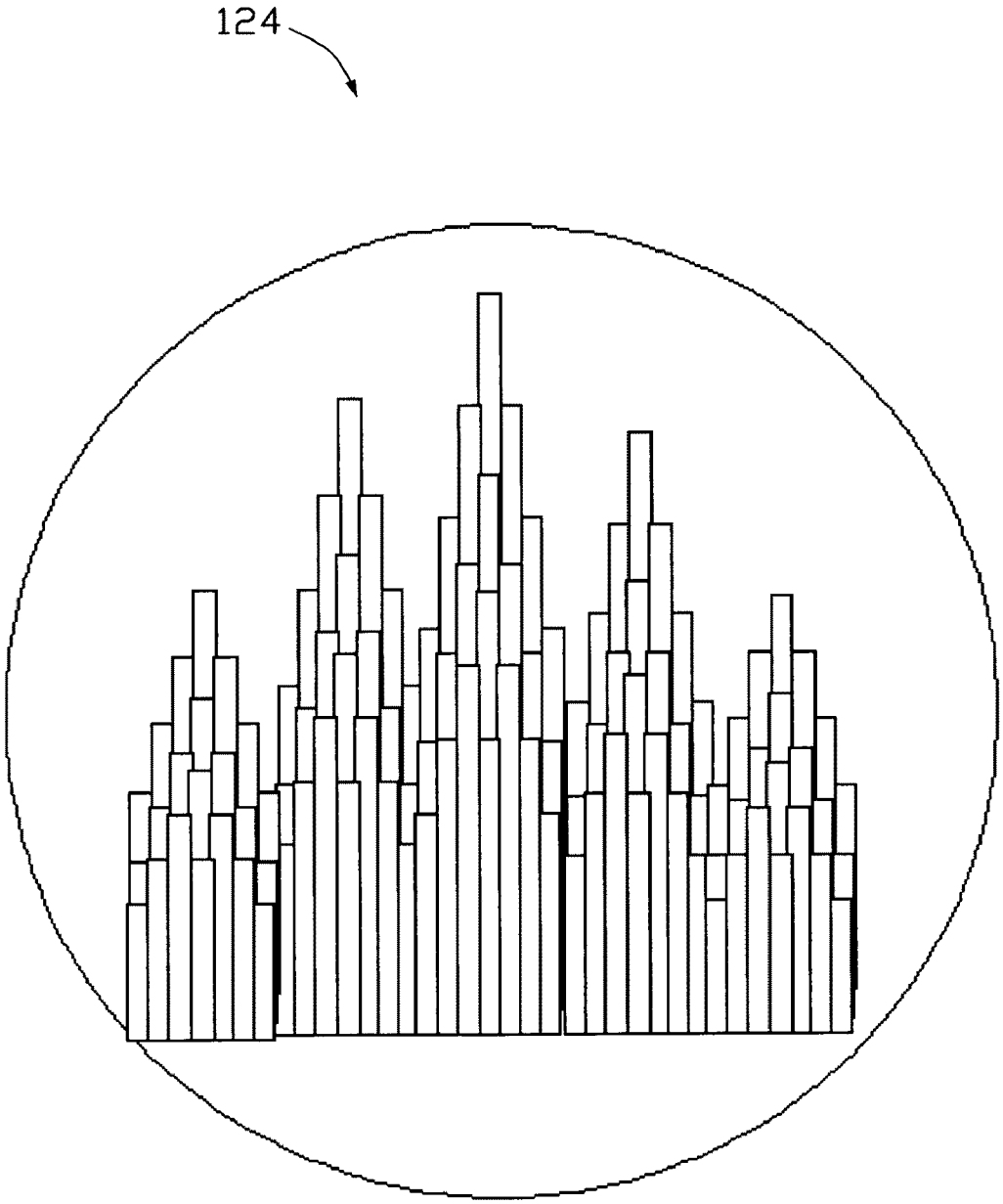
FIG. 2 is a schematic, amplificatory view of part II in FIG. 1.
Figure 3:
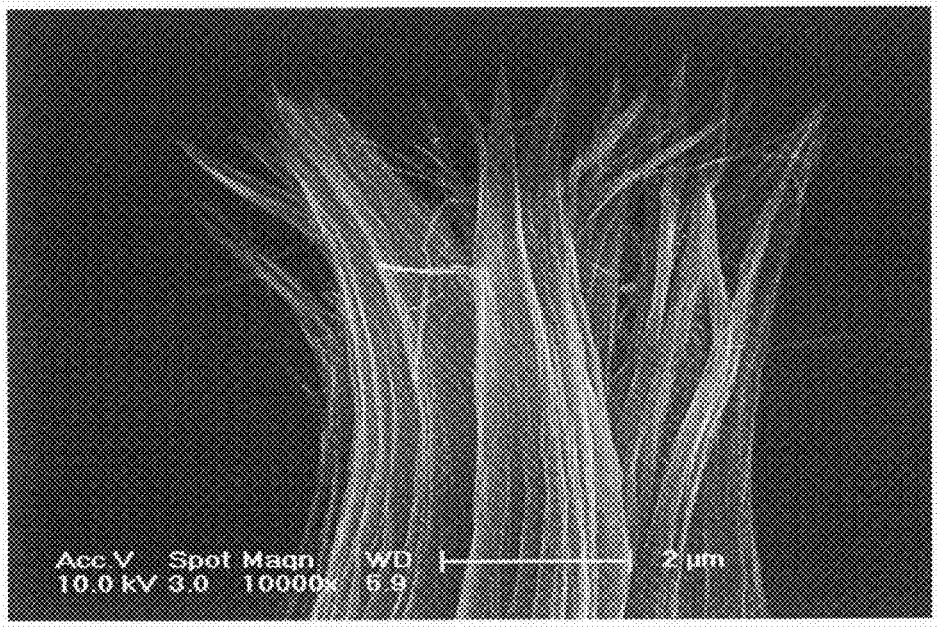
FIG. 3 is a Scanning Electron Microscope (SEM) photo, showing part II in FIG. 1.
Figure 4:
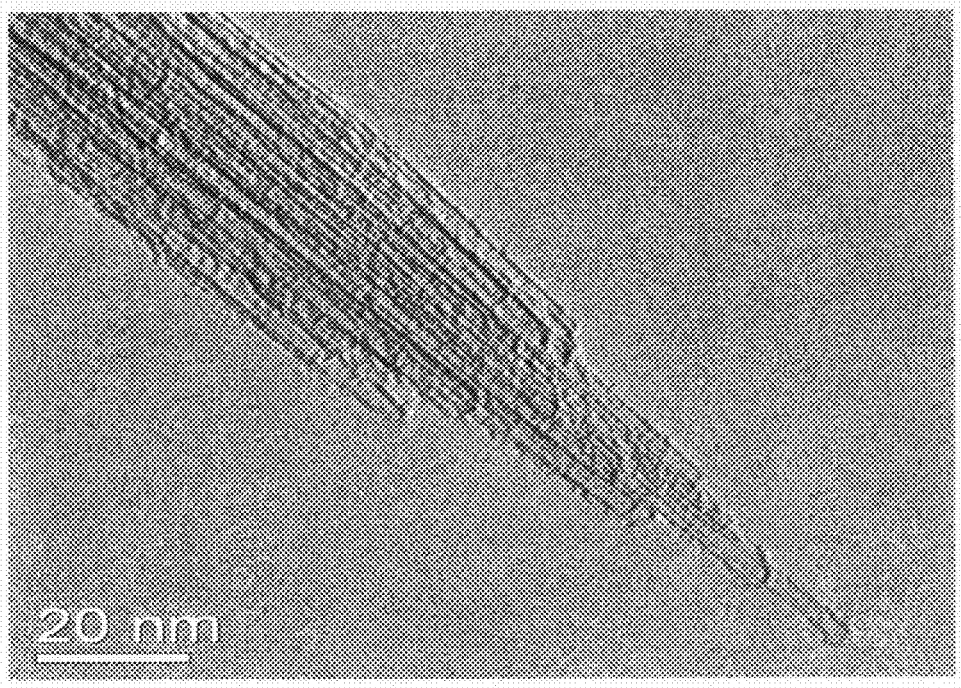
FIG. 4 is a Transmission Electron Microscope (TEM) photo, showing art II in FIG. 1.

The CNT string 12 is composed of a number of CNT bundles packed closely, and each of the CNT bundles includes a number of CNTs, which are substantially parallel to each other and are joined by van der Waals attractive force. A diameter of the CNT string 12 is in an approximate range from 1 to 100 microns (μm), and a length thereof is in an approximate range from 0.1-10 centimeters (cm). Referring to FIGS. 2, 3 and 4, the CNTs at the broken end portion 124 form a tooth-shaped structure, i.e., some CNTs protruding and higher than the adjacent CNTs. The CNTs at the broken end portion 124 have smaller diameter and fewer number of graphite layer, typically, less than 5 nanometer (nm) in diameter and about 2-3 in wall. However, the CNTs in the CNT string 12 other than the broken end portion 124 are about 15 nm in diameter and more than 5 in wall. The conductive base 14 is made of an electrically conductive material, such as nickel, copper, tungsten, gold, molybdenum or platinum, or an insulated base with a conductive film formed thereon.

Figure 5:
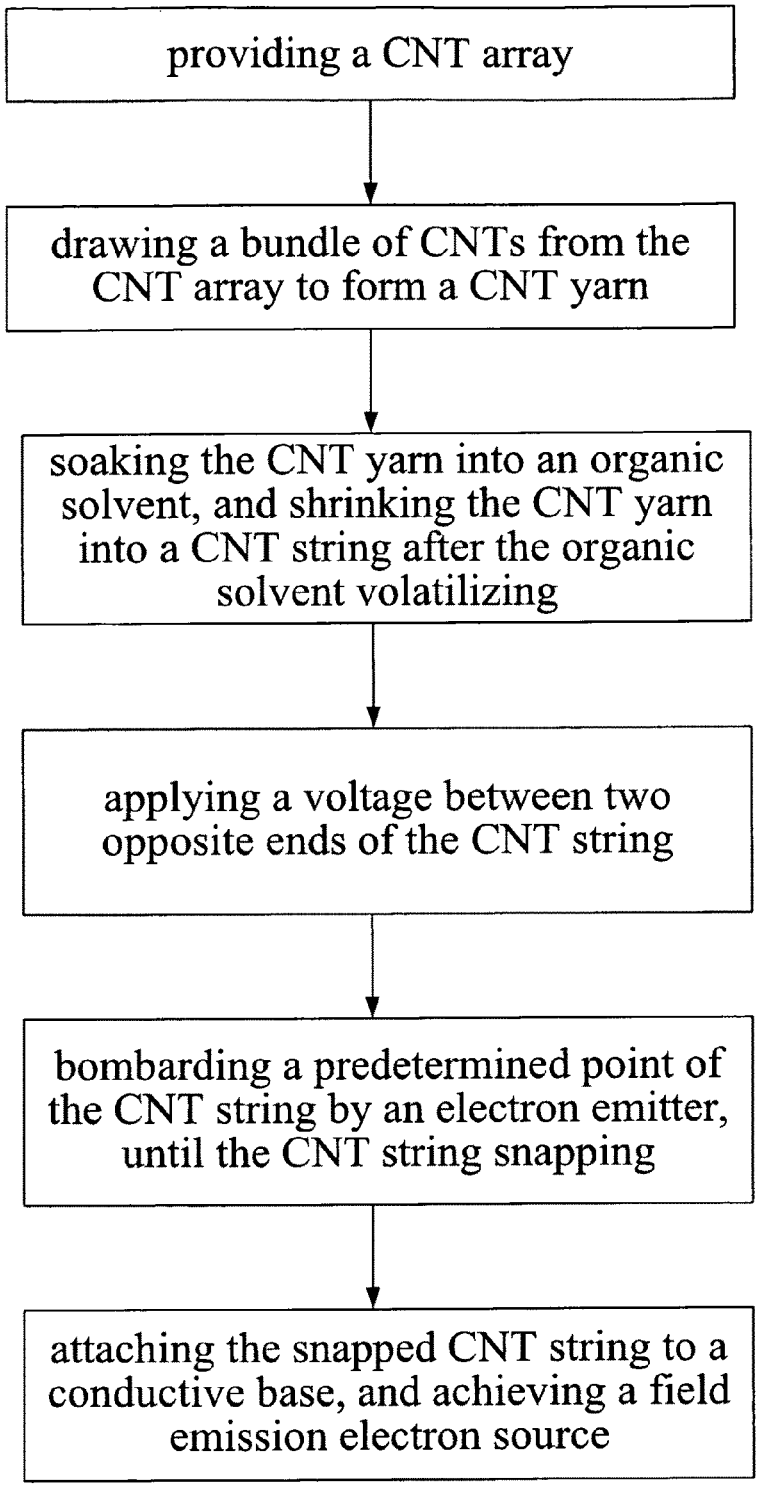
FIG. 5 is a process chart showing the steps of the present method for manufacturing the field emission electron source.

Referring to FIG. 5, a method for manufacturing the field emission electron source is illustrated as following steps:

Step 1, providing a CNT array;

Step 2, drawing a number of CNT bundles from the CNT array to form a CNT yarn;

Step 3, soaking the CNT yarn in an organic solvent, and shrinking the CNT yarn into a CNT string after the organic solvent volatilizing;

Step 4, applying a voltage between two opposite ends of the CNT string;

Step 5, bombarding a predetermined point of the CNT string by an electron emitter, until the CNT string snapping; and Step 6, attaching the snapped CNT string to a conductive base, and achieving a field emission electron source.

In step 1, the CNT array is a super-aligned CNT array, which is grown using a chemical vapor deposition method. The method is described in U.S. Pat. No. 7,045,108, which is incorporated herein by reference. Firstly, a substrate is provided, and the substrate is a substrate of p type silicon or n type silicon. Secondly, a catalyst layer is deposited on the substrate. The catalyst layer is made of a material selected from a group consisting of iron (Fe), cobalt (Co), nickel (Ni), and their alloys. Thirdly, the substrate with the catalyst layer is annealed at a temperature in an approximate range from 300 to 400 degrees centigrade under a protecting gas for about 10 hours. Fourthly, the substrate with the catalyst layer is heated to approximately 500 to 700 degrees centigrade and a mixed gas including a carbon containing gas and a protecting gas is introduced for about 5 to 30 minutes to grow a super-aligned CNTs array. The carbon containing gas can be a hydrocarbon gas, such as acetylene or ethane. The protecting gas can be an inert gas. The grown CNTs are aligned parallel in columns and held together by van der Waals force interactions. The CNTs array has a high density and each one of the CNTs has an essentially uniform diameter.

In step 2, a CNT yarn may be obtained by drawing a number of the CNT bundles from the super-aligned CNTs array. Firstly, the CNT bundles including at least one CNT are selected. Secondly, the CNT bundles are drawn out using forceps or adhesive tap, to form a CNT yarn along the drawn direction. The CNT bundles are connected together by van der Waals force interactions to form a continuous CNT yarn. Further, the CNT yarn can be treated by a conventional spinning process, and a CNT yarn in a twist shape is achieved.

In step 3, the CNT yarn is soaked in an organic solvent. The step is described in U.S. Pat. Pub. No. 2007/0166223, which is incorporated herein by reference. Since the untreated CNT yarn is composed of a number of the CNTs, the untreated CNT yarn has a high surface area to volume ratio and thus may easily become stuck to other objects. During the surface treatment, the CNT yarn is shrunk into a CNT string 12 after the organic solvent volatilizing, due to factors such as surface tension. The surface area to volume ratio and diameter of the treated CNT string 12 is reduced. Accordingly, the stickiness of the CNT yarn is lowered or eliminated, and strength and toughness of the CNT string 12 is improved. The organic solvent may be a volatilizable organic solvent, such as ethanol, methanol, acetone, dichloroethane, chloroform, and any combination thereof. A diameter of the CNT string 12 is in an approximate range from 1 to 100 microns (μm), and a length thereof is in an approximate range from 0.1-10 centimeters (cm).

Figure 6:
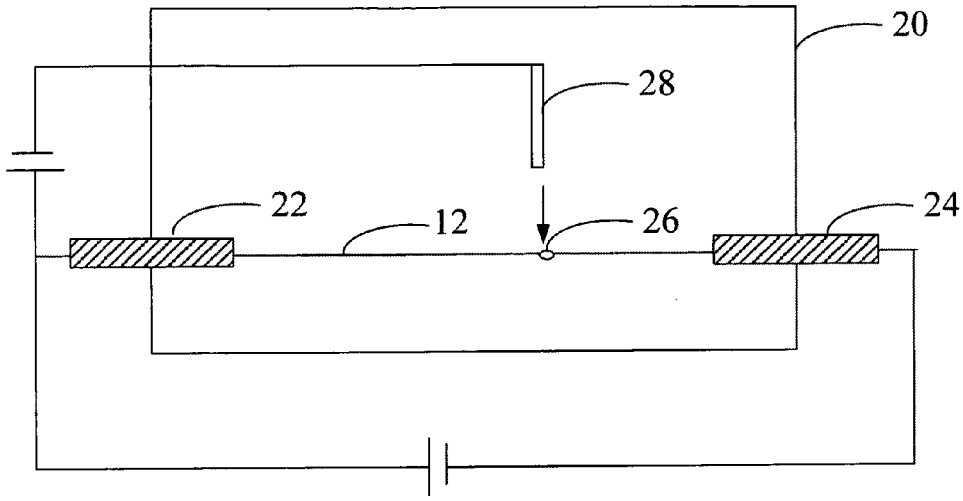
FIG. 6 is a schematic view, showing a voltage being applied on the CNT string and an electron source bombarding at a predetermined point of the CNT string.

Referring to FIG. 6, the step 4 includes the following sub-steps:

In sub-step (1), the CNT string 12 is placed in a chamber 20. The chamber 20 may be vacuum or filled with an inert gas. A diameter of the CNT string 12 is in an approximate range from 1 to 100 microns (μm), and a length thereof is in an approximate range from 0.1-10 centimeters (cm). In the present embodiment, the vacuum chamber 20 includes an anode 22 and a cathode 24, which lead (i.e., run) from inside to outside thereof. Two opposite ends of CNT string 12 are attached to and electrically connected to the anode 22 and the cathode 24, respectively.

In sub-step (2), a voltage is applied between the anode 22 and the cathode 24 to apply a voltage on two opposite ends of the CNT string 12. The voltage is determinated according to a diameter and/or a length of the CNT string 12. In the present embodiment, the CNT yarn 12 is 2 cm in the length and 25 μm in the diameter, and then a 40 voltage (V) DC dias is applied between the anode 22 and the cathode 24 to heat the CNT string 12, under a vacuum of less than $2\times10^{-3}$ Pascal (Pa), beneficially, $2\times10^{-5}$ Pa. When the voltage is applied to the CNT string 12, a current flows through the CNT string 12. Consequently, the CNT string 12 is heated by Joule-heating, and a temperature of the CNT string 12 can reach an approximate range from 1800 to 2500 Kelvin (K).

In step 5, an electron emitter 28 is used to bombard a predetermined point 26 of the CNT string 12. The predetermined point 26 is located along the longitudinal axis of the CNT string 12. The electron emitter 28 is arranged in the chamber 20. A distance between the electron emitter 28 and the CNT string 12 is in an approximate range from 50 microns (μm) to 2 millimeters (mm), typically, 50 μm. The electron emitter 28 can be in any direction, only if the electron emitted therefrom can bombard the predetermined point 26. With the electron bombarding, a temperature of the predetermined point 26 is enhanced, and thus the temperature thereof is higher than the other points along the longitudinal axis of the CNT string 12. Consequently, the CNT string 12 previously snaps at the predetermined point 26, and then two snapped CNT string 12 each with a broken end portion 124 are formed.

The CNTs at the broken end portion 124 have smaller diameter and fewer number of graphite layer, typically, less than 5 nanometer (nm) in diameter and about 2-3 in wall. However, the CNTs in the CNT string 12 other than the broken end portion 124 are about 15 nm in diameter and more than 5 in wall. The diameter and the number of the graphite layers of the CNTs are decreased in a vacuum breakdown process. A wall by wall breakdown of CNTs is due to Joule-heating at a temperature higher than 2000 K, with a current decrease process. The high-temperature process can efficiently remove the defects in CNTs, and consequently improve electric and thermal conductivity, and mechanical strength thereof.

Figure 7:
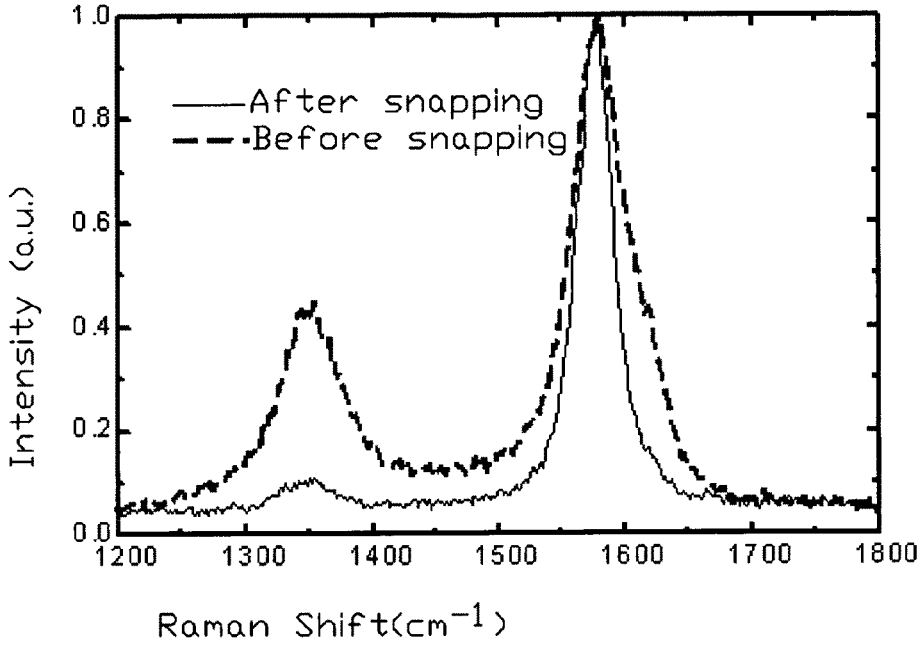
FIG. 7 is a Raman spectrum of the broken end portion of the field emission electron source.

FIG. 7 shows a Raman spectrum of the broken end portion 124. After snapping, the intensity of D-band (defect mode) at 1350 $cm^{-1}$ is reduced, which indicates the structure effects at the broken end portion 124 are effectively removed, and thus the electric and thermal conductivity, and mechanical strength of the CNT string 12 are improved. Therefore, the field emission efficiency of the CNT string 12 is improved.

Moreover, during snapping, some carbon atoms vapor from the CNT string 12. After snapping, a micro-fissure (no labeled) is formed between two broken end portions 124, the arc discharge may occur between the micro-fissure, and then the carbon atoms are transformed into the carbon ions due to ionization. These carbon ions bombard/etch the broken end portions 124, and then the broken end portion 124 form the tooth-shaped structure. Therefore, a shield effect caused by the adjacent CNTs can be reduced. The field emission efficiency of the CNT string 12 is further improved.

In step 6, the snapped CNT string 12 is in contact with/electrically connected to a conductive base 14 by silver paste. The broken end portion 124 is a free end functioning as the electron emitters, and then a field emission electron source 10 is formed.

Figure 8:
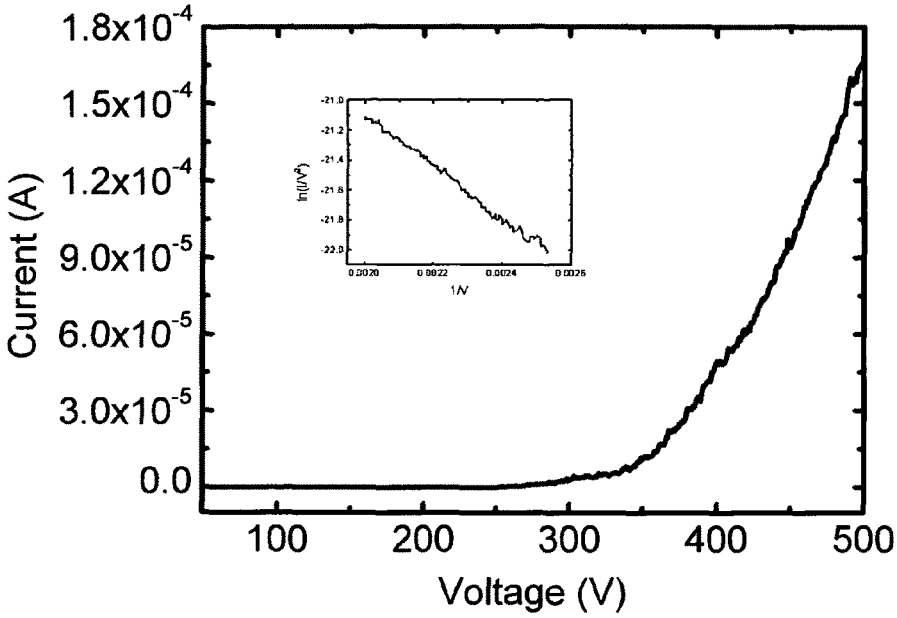
FIG. 8 is a current-voltage graph of the field emission electron source.

FIG. 8 shows an I-V graph of the present field emission electron source. A threshold voltage thereof is about 250 V, an emission current thereof is over 150 μA. The diameter of the broken end portion is about 5 μm, and thus a current density can be calculated over 700 $A/cm^2$. The inset of FIG. 8 shows a Fowler-Nordheim (FN) plot, wherein the straight line ($\ln(I/V^2)$ via $1/V$) indicate a typical field emission efficiency of the field emission electron source.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A method for manufacturing a field emission electron source comprising:

providing a CNT array;

drawing plurality of CNT bundles from the CNT array to form a CNT yarn;

soaking the CNT yarn into an organic solvent, and shrinking the CNT yarn into a CNT string after the organic solvent volatilizing;

applying a voltage between two opposite ends of the CNT string;

bombarding a predetermined point of the CNT string by an electron emitter and maintaining the voltage, until the CNT string snaps, wherein the snapped CNT string comprises a broken end portion comprising a plurality of CNT bundles, each of the plurality of CNT bundles has a taper shaped end comprising a plurality of CNTs, and some CNTs protrude higher than other adjacent CNTs; and attaching the snapped CNT string to a conductive base.

2. The method as claimed in claim 1, wherein the CNT array is a super-aligned CNT array.

3. The method as claimed in claim 1, wherein the CNT yarn comprises a plurality of CNTs, and the plurality of CNTs is closely attached to each other by van der Waals attractive force.

4. The method as claimed in claim 1, wherein the voltage is determined by a diameter and a length of the CNT string.

5. The method as claimed in claim 4, wherein the diameter of the CNT string is in an approximately range from 1 micron to 100 microns.

6. The method as claimed in claim 4, wherein the length of the CNT string is in an approximately range from 0.1 centimeters to 10 centimeters.

7. The method as claimed in claim 4, wherein the voltage is about 40 volts.

8. The method as claimed in claim 1, wherein the snapped CNT string comprises an end portion and the broken end portion opposite to the end portion.

9. The method as claimed in claim 8, wherein the CNTs at the broken end portion have a diameter of less than 5 nanometer, and the number of graphite layer in about 2-3 walls.

10. The method as claimed in claim 8, wherein the end portion of the snapped CNT string is attached to the conductive base by a conductive paste.

11. The method as claimed in claim 1, wherein after being applied a voltage, a temperature of the CNT string reaches an approximate range from 1800 to 2500 kelvins.

12. The method as claimed in claim 1, wherein the conductive base is composed of a conductive material or an insulated base with a conductive film formed on the insulated base.

13. The method as claimed in claim 1, wherein a threshold voltage of the field emission electron source is about 250 voltages, and an emission current of the field emission electron source is more than 150 microamperes.

14. The method as claimed in claim 1, wherein the step of applying the voltage between two opposite ends of the CNT string is performed in an inert gas or in a vacuum.

15. The method as claimed in claim 14, wherein the step of applying the voltage between two opposite ends of the CNT string is performed in a vacuum with a pressure of about $10^{-3}$ Pa to about $10^{-5}$ Pa.

16. The method as claimed in claim 1, wherein a distance between the electron emitter and the CNT string is in an approximate range from 50 microns to 2 millimeters.

17. A method for manufacturing a field emission electron source, the method comprising:

providing a CNT string comprising a plurality of CNTs closely attached to each other by van der Waals attractive force;

applying a voltage between two opposite ends of the CNT string;

bombarding a predetermined point of the CNT string by an electron emitter and maintaining the voltage, to form two snapped CNT strings, wherein each of the two snapped CNT strings comprises a broken end portion comprising a plurality of CNT bundles, each of the plurality of CNT bundles has a taper shaped end comprising a plurality of substantially parallel CNTs, and a single CNT of the plurality of substantially parallel CNTs taller than and projecting over other substantially parallel CNTs; and attaching at least one of the two snapped CNT strings to a conductive base.

18. A method for manufacturing a field emission electron source, the method comprising:

providing a CNT string comprising a plurality of CNTs closely attached to each other by van der Waals attractive force;

applying a voltage between two opposite ends of the CNT string;

bombarding a predetermined point of the CNT string by an electron emitter and maintaining the voltage, to form two snapped CNT strings, each of the two snapped CNT strings comprising a broken end portion, and the broken end portion comprises a plurality of CNT bundles, each of the plurality of CNT bundles has a taper shaped end comprising a plurality of substantially parallel CNTs, and some substantially parallel CNTs protrude higher than other adjacent substantially parallel carbon nanotubes;

generating an arc discharge between two broken portions, and carbon atoms of the two broken end portions being transformed into carbon ions to bombard the broken end portion, to form a tooth-shaped structure; and attaching at least one of the two snapped CNT strings to a conductive base.

19. The method as claimed in claim 18, wherein a single CNT of the plurality of substantially parallel CNTs is taller than and projects over other substantially parallel CNTs.

20. The method as claimed in claim 19, wherein the single CNT is located in the middle of the other substantially parallel CNTs.

* * * * *